US008277187B2

(12) United States Patent
Schlüter et al.

(10) Patent No.: US 8,277,187 B2
(45) Date of Patent: Oct. 2, 2012

(54) RADIAL COMPRESSOR ROTOR

(75) Inventors: Lars Schlüter, Moers (DE); Theodor Wallmann, Neukirchen-Vluyn (DE)

(73) Assignee: Siemens Aktiengesellschaft, München (DE)

( * ) Notice: Subject to any disclaimer, the term of this patent is extended or adjusted under 35 U.S.C. 154(b) by 859 days.

(21) Appl. No.: 12/084,920

(22) PCT Filed: Oct. 30, 2006

(86) PCT No.: PCT/EP2006/067919

§ 371 (c)(1),
(2), (4) Date: Mar. 27, 2009

(87) PCT Pub. No.: WO2007/057292

PCT Pub. Date: May 24, 2007

(65) Prior Publication Data

US 2009/0220346 A1 Sep. 3, 2009

(30) Foreign Application Priority Data

Nov. 16, 2005 (EP) ..... 05025048

(51) Int. Cl.
*B63H 1/16* (2006.01)
*B64C 11/00* (2006.01)
*B64C 27/20* (2006.01)
*F01D 5/22* (2006.01)
*F03D 11/00* (2006.01)

(52) U.S. Cl. ..... 416/188; 416/185; 416/182; 416/176; 416/223 R

(58) Field of Classification Search ..... 416/188, 416/185, 176, 182, 223 R
See application file for complete search history.

(56) References Cited

U.S. PATENT DOCUMENTS 5,685,696 A * 11/1997 Zangeneh et al. ..... 416/186 R
5,730,582 A * 3/1998 Heitmann ..... 416/188
6,588,485 B1 7/2003 Decker
2005/0260074 A1 11/2005 Higashimori

FOREIGN PATENT DOCUMENTS

DE 897 470 C 12/1953
WO WO 2005/090794 A1 9/2005

* cited by examiner

*Primary Examiner* — Toan Le

(57) ABSTRACT

A radial compressor rotor is provided for stabilizing the flow behavior of a delivery gas, consisting of a wheel disc and blades arranged uniformly in the circumferential direction, wherein the generatrix of the surface of the blades is designed as a curved line at least in a curved section, such that the surface is curved in two directions in this section.

16 Claims, 4 Drawing Sheets

RADIAL COMPRESSOR ROTOR

CROSS REFERENCE TO RELATED APPLICATIONS

This application is the US National Stage of International Application No. PCT/EP2006/067919, filed Oct. 30, 2006 and claims the benefit thereof. The International Application claims the benefits of European application No. 05025048.9 filed Nov. 16, 2005, both of the applications are incorporated by reference herein in their entirety.

FIELD OF INVENTION

The invention relates to a radial compressor rotor, consisting of a wheel disk and blades which are arranged uniformly in the circumferential direction and have a leading edge and a trailing edge, at least one section of the surface of the blades being a double-curved section, the generatix of which is designed as a curved line, and the curved section likewise being curved perpendicularly to the generatix. The invention also relates to a method of producing a radial compressor rotor of this type.

BACKGROUND OF THE INVENTION

Radial compressors convert mechanical energy into pressure energy by utilizing the centrifugal acceleration. Radial compressors essentially comprise a rotor, which is fastened to a driving shaft, a diffuser and a casing. The rotor has a plurality of curved blades. Depending on the intended use, the mechanical design of the rotor is effected like a closed or half-open rotor. In closed rotors, the blades are provided with a cover disk; in half-open rotors, the blades have a free outer edge.

The delivery gas is drawn in approximately in the center of the compressor and is compressed by the centrifugal force, also assisted by the curved shape of the blades, and accelerated outward. In the circumferentially arranged diffuser, the kinetic energy is mostly converted into additional pressure and the deliver gas is further compressed.

The energy conversion in radial compressors is associated with corresponding flow, friction and gap losses, for which reason radial compressors have a curved characteristic. In addition to a high efficiency, a stable characteristic is therefore aimed at, said characteristic being distinguished by an increasing delivery pressure at a decreasing delivery flow. However, the operating range of a radial compressor is restricted by the "surge limit". This is generally the point of the characteristic having the smallest delivery quantity. The radial compressor can no longer be used on the other side of the surge limit, for the flow separates from the blades and stable operation can no longer be ensured.

The problem of stabilizing the characteristic of a radial compressor is treated, for example, in DE 42 14 753 A1. This document discloses a radial compressor rotor according to the preamble. The blades of this rotor are provided with through-holes, through which the delivery gas is fed from a convex blade pressure side to a concave blade suction side, such that the vortices which are formed on the blade suction side at small volumetric flows and high pressure ratios are removed.

Documents WO 2005/090794 A and U.S. Pat. No. 6,588,485 B1 have already disclosed radial compressor rotors having double-curved sections of the surface. In these embodiments, the entire surface is designed as a sculptured surface, a factor which firstly is complicated with regard to the description of the geometry and secondly involves a high production cost. DE 897 470 C has already disclosed a double-curved surface of a compressor blade mentioned at the beginning, produced by means of a crowned surface of a milling cutter. A blade produced in such a way cannot take into account the complexity of a three-dimensional flow.

SUMMARY OF INVENTION

The object of the invention is to specify a radial compressor rotor which permits an increased stable operating range with at the same time high efficiency. The object of the invention is also to specify a production method for such a radial compressor rotor.

The first-mentioned object is achieved according to the invention by a radial compressor rotor as claimed in the claims. The claims that refer back contain advantageous developments of the invention.

The blades have a leading edge and a trailing edge, at least one section of the surface of the blades being a double-curved section, the generatix of which is designed as a curved line, and the curved section likewise being curved perpendicularly to the generatix.

The surface in the curved section is of double-curved design; i.e., starting from a point on the surface of the curved section, the surface is curved in two directions spanning the surface. All the lines running through this point are therefore curved and are not designed as straight lines. The curved section is characterized overall in that all the lines—including the generatix—on the surface are curved in this section. This region therefore forms a "sculptured surface".

The expression "generatix" refers in this case to a line which is part of the surface in a direction spanning the surface (for example the x direction) and thus has and defines the course of the surface in this direction. The surface is formed and defined by the movement or displacement of the generatix in a second direction (for example the y direction, perpendicular to the x direction) which does not run parallel to the generatix. In this case, the generatix need not inevitably be static, but rather it can vary in the second direction as a function of the position of the generatix.

The advantage of the invention can be seen in particular in the fact that a double-curved surface is better adapted to the three-dimensional development of the flow and therefore an improved flow behavior results. The stable flow behavior leads firstly to the stabilizing of the compressor characteristic and to the increase in the efficiency of the radial compressor.

In contrast, modern blade surfaces of radial compressor rotors are often defined by means of rectilinear generatrices. The expression "ruled surfaces" or "ruled-surface straight lines" is used in this connection. To produce these surfaces, recourse is normally had to a machining operation by flank milling by means of cylindrical or tapered plain milling cutters. In this case, the milling cutter is brought into engagement in such a way that its ideal generating line in the cutting region is oriented parallel to the respective ruled-surface straight line of the blade surface.

In a preferred configuration, a further section of the surface of the blades is designed as a ruled-surface section, the generatix of which is designed as a straight line. This section therefore forms a ruled surface, such that at least one straight line runs through each point of this section.

It is also preferable that the transition from the double-curved section to the ruled-surface section is continuous. There are thus no kinks or edges between these two sections. The transition between these two sections is rounded. This ensures that no turbulence is produced by separation of the flow on account of unevenness on the surface.

The blades preferably have a hub edge and an approximately opposite outer edge, the double-curved section adjoining the outer edge and the ruled-surface section adjoining the hub edge. The hub edge is an edge adjoining a hub of the wheel disk; it is thus located in the bottom region of the blade. The outer edge lies approximately opposite the hub edge. In half-open rotors, it is designed as a free edge. In closed rotors, it adjoins the cover disk. The outer edge, hub edge, leading edge and trailing edge define the blade, the outer edge and the hub edge each connecting the leading edge to the trailing edge.

The double-curved section and/or the ruled-surface section expediently extends from the leading edge up to the trailing edge.

According to a further expedient development, the double-curved section and the ruled-surface section are approximately the same size.

In a preferred embodiment, the surface of the blades has a plurality of double-curved sections. In particular, the surface consists of a plurality of double-curved and ruled-surface sections which are arranged alternately, as a result of which the aerodynamic properties of the blade are improved.

A further advantageous embodiment is obtained by a respective double-curved section being provided adjacent to the hub edge and the outer edge, between which double-curved sections a ruled-surface section is arranged.

Efficient deflection of the flow with reduced separation risk is achieved according to an especially preferred embodiment by the entire surface of the blades being double-curved, that is to say by it being formed completely by a curved generatix.

The positive effect of the geometry of the blades on the stable behavior of the flow is advantageously enhanced by a curved leading edge.

Since the behavior of the flow in the longitudinal direction of the blades varies, the blades are preferably designed in such a way that the curvature of the generatix varies from the leading edge in the direction toward the trailing edge. This means that the generatix of the double-curved section, said generatix extending in the transverse direction of the blades, has a curvature trend which varies in the longitudinal direction of the blade.

The wheel disk, the blades and where appropriate the cover disk form separate units. The individual elements of the rotor can be produced separately and joined together later, such that a high number of degrees of freedom are ensured in particular for the design of the blades.

The object is also achieved according to the invention by a method of producing a radial compressor rotor as claimed in the claims. On account of the geometrical features of the blades, a production process in which the milling cutter contacts the blade surface linearly, as is the case, for example, when using a plain milling cutter in a conventional manner, cannot be applied. The design of the double-curved sections requires point-like contact between the milling cutter and the blade surface, said point-like contact ensuring additional degrees of freedom in the production of the blades. This point-like contact takes place during end milling. Accordingly, a large number of milling paths are provided in order to achieve a sufficiently high surface quality. The entire surface, in the ruled-surface section too, can be formed by end milling.

BRIEF DESCRIPTION OF THE DRAWINGS

Exemplary embodiments of the invention are explained in more detail with reference to the drawing, in which.

The same designations have the same meaning in the various figures.

DETAILED DESCRIPTION OF INVENTION

Figure 1:
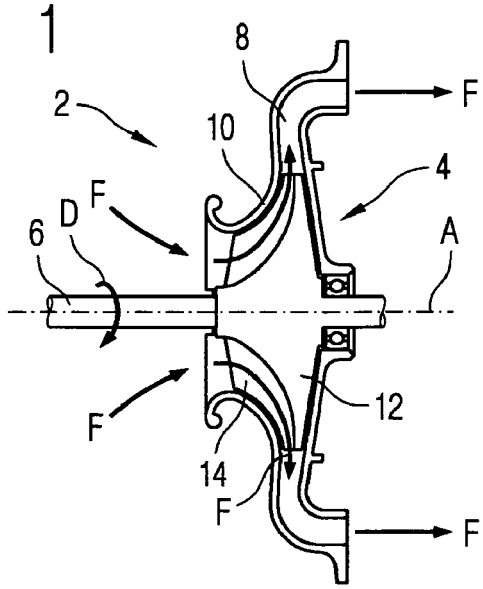
FIG. 1 shows a schematic section in the axial direction through a single-stage radial compressor.

A radial compressor 2 working in a single-flow manner (delivery gas feed only from one side) and in a single-stage manner is shown in FIG. 1. The radial compressor 2 comprises a rotor 4, a shaft 6, which rotates in rotation direction D and on which the rotor 4 is attached and which defines an axial direction A, and a diffuser 8 and a cover disk 10. The rotor 4 consists of a wheel disk 12 and a plurality of blades 14 arranged over the circumference.

The delivery gas is drawn in axially in the region of the shaft 6 and is accelerated radially outward by the centrifugal force through the passages produced between the blades. This is indicated by the arrows F, which specify the flow direction of the delivery gas. In the process, both the velocity and the pressure of the delivery gas increase. The flow is decelerated in the diffuser 8, which leads to a further increase in the pressure of the delivery gas. After the compression, the delivery gas leaves the radial compressor again in the axial direction.

Figure 2A:
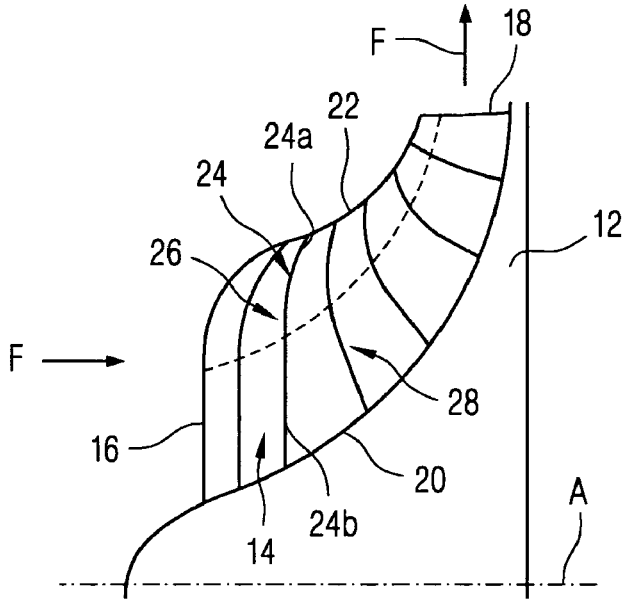
FIG. 2*a* shows a schematic side view of a blade having a double-curved and a ruled-surface section.
Figure 2B:
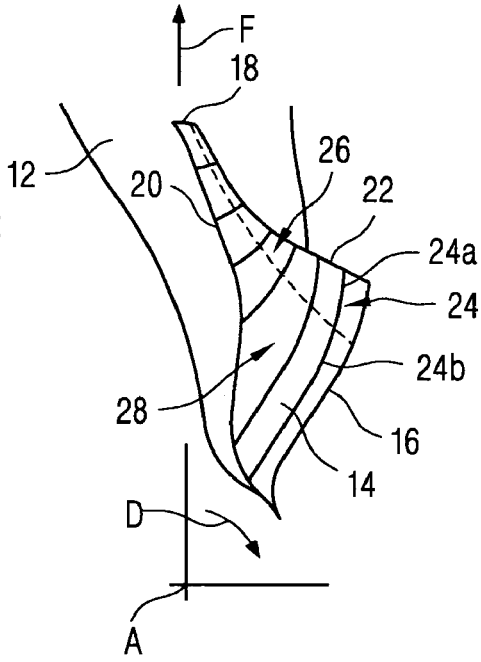
FIG. 2*b* shows a schematic plan view of the blade according to FIG. 2*a*.

In particular the aerodynamic geometry of the blades 14 helps to satisfactorily convert the energy. This geometry is shown, for example, in FIG. 2*a* and FIG. 2*b*, which show a side view and a plan view of a first embodiment of the blades 14. The blade 14 has a leading edge 16. At the other end, in the longitudinal direction of the blade 14, is a trailing edge 18, which is oriented relative to the diffuser 8 in the fitted state. In a closed rotor 2, the blade 14 is provided with a cover disk 10; in a half-open rotor, the blade 14 has a free trailing edge 18. A hub edge 20 of the blade 14 extends over the surface of the wheel disk 12 and directly adjoins the latter in a hub region. In an approximately opposite location, the blade 14 has an outer edge 22. The generatrix 24 of the blade surface leading with respect to the rotation direction D is convexly curved.

The surface of the blades 24 is defined by a respective generatrix 24. The latter extends in each case in the transverse direction of the blade 14, i.e. from the hub edge 20 to the outer edge 22. The generatrix 24 varies in the longitudinal direction of the blade 14, that is to say in the direction from the leading edge 16 to the trailing edge 18. Considered in another way, the entire surface is composed of a multiplicity of infinitesimal sectional surfaces which are each defined by a different static generatrix.

In the transverse direction of the blade 14, i.e. between the hub edge 20 and the outer edge 22, the surface is divided into a double-curved section 26 and a ruled-surface section 28. The double-curved section 26 adjoins the outer edge 22 and extends in the longitudinal direction from the leading edge 16 up to the trailing edge 18. The ruled-surface section 28 adjoins the hub edge 20 and extends in the same way as the double-curved section 26 along the entire blade 14. The two sections 26, 28 form a continuous transition between them, such that the surface of the blade 14 has no edges, grooves or prominences which could have an adverse effect on the development of the flow.

On account of the two sections 26, 28, the generatrix 24 is also divided into a curved region 24*a* and a ruled-surface region 24*b*, which merge continuously into one another. In particular due to the three-dimensional curvature in the double-curved section 26, the shape of the blade 14 is adapted to the flow requirements with regard to the stabilization of the flow.

The complex geometry of the blades 14 requires a production method which ensures degrees of freedom in all three spatial directions when fabricating the double-curved sections 26. Especially suitable in this case is the use of an end mill, which can produce curved planes having different directions of curvature and radii of curvature by point-like contact with the surface of the blade 14.

Figure 3A:
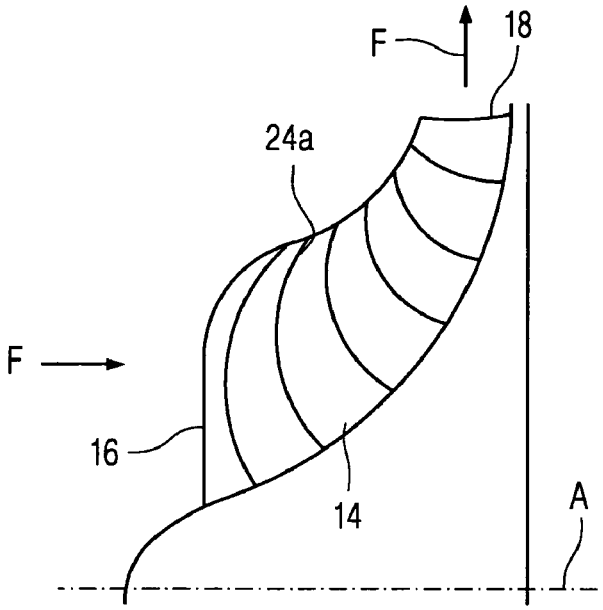
FIG. 3*a* shows a schematic side view of a blade having a leading edge convexly curved in the flow direction.
Figure 3B:
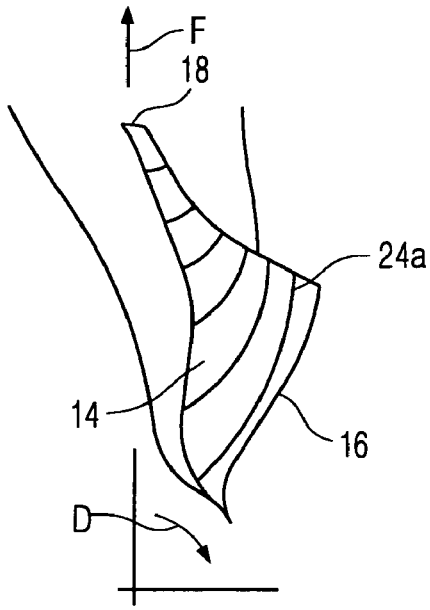
FIG. 3*b* shows a schematic plan view of the blade according to FIG. 3*a*.

A further embodiment of the blade 14 is shown in FIGS. 3*a* and 3*b*. The blade 14 has, for its entire surface, a curved generatrix 24*a* which extends from the leading edge 16 up to the trailing edge 18 and is oriented concavely relative to the flow direction F of the delivery gas. It can also be seen from FIGS. 3*a* and 3*b* that the curvature trend of the generatrix 24*a* varies in the flow direction F from the leading edge 16 up to the trailing edge 28. In the side view in FIG. 3*a*, the blade has a convexly curved leading edge 16.

Figure 4A:
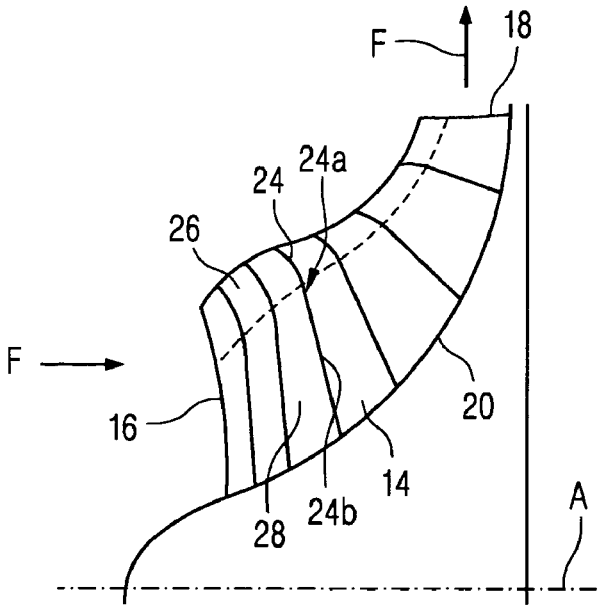
FIG. 4*a* shows a schematic side view of a blade having a leading edge concavely curved in the flow direction.
Figure 4B:
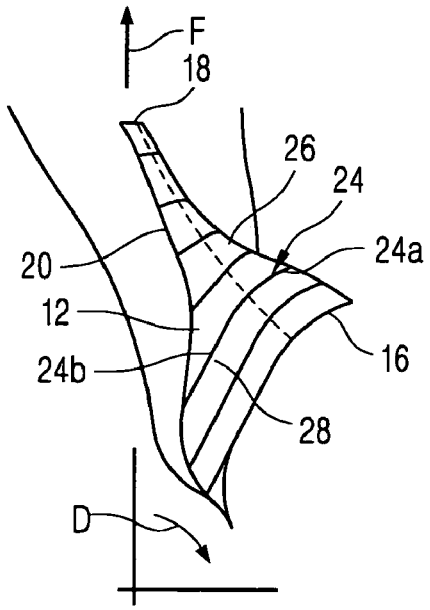
FIG. 4*b* shows a schematic plan view of the blade according to FIG. 4*a*.

In the exemplary embodiment in FIG. 4*a* and FIG. 4*b*, the generatrix 24 of the blade surface leading with respect to the rotation direction D is concavely curved. Here, too, as in the exemplary embodiment in FIGS. 2*a* and 2*b*, a double-curved section 26 and a ruled-surface section 28 are provided. In this case, the double-curved section 26 forms approximately ⅓ of the entire surface. Illustrated in the exemplary embodiment in FIGS. 4*a*, 4*b* is a further preferred configuration of the blades 14, namely a leading edge 16 which is concavely curved in the side view in FIG. 4*a* and which improves the aerodynamic properties of the blade 14.

Figure 5A:
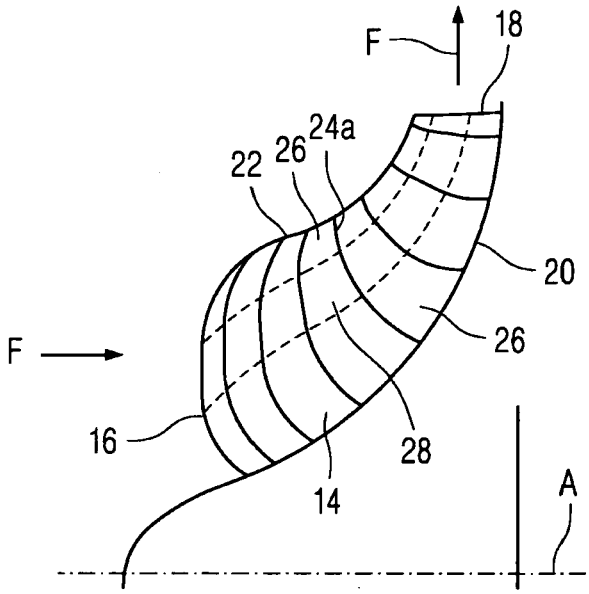
FIG. 5*a* shows a schematic side view of a blade having two double-curved sections, between which a ruled-surface section is arranged.
Figure 5B:
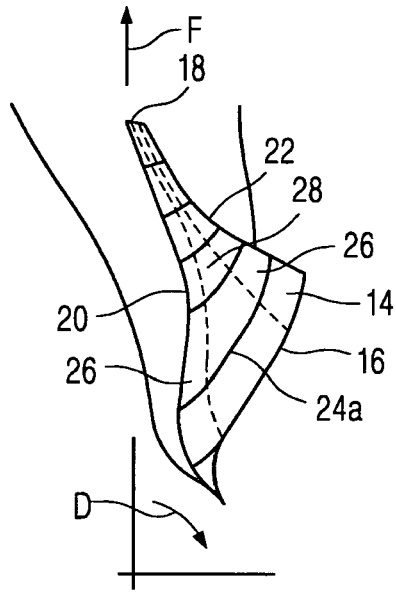
FIG. 5*b* shows a schematic plan view of the blade according to FIG. 5*a*.

According to another exemplary embodiment, the blade 14 has two double-curved sections 26 which adjoin the hub edge 20 and the outer edge 22 and between which a ruled-surface section 28 is arranged. This is shown in FIG. 5*a* and FIG. 5*b*. In this case, the leading edge 16 is again of curved design. The individual sections 26, 28 are approximately the same size.

Figure 6A:
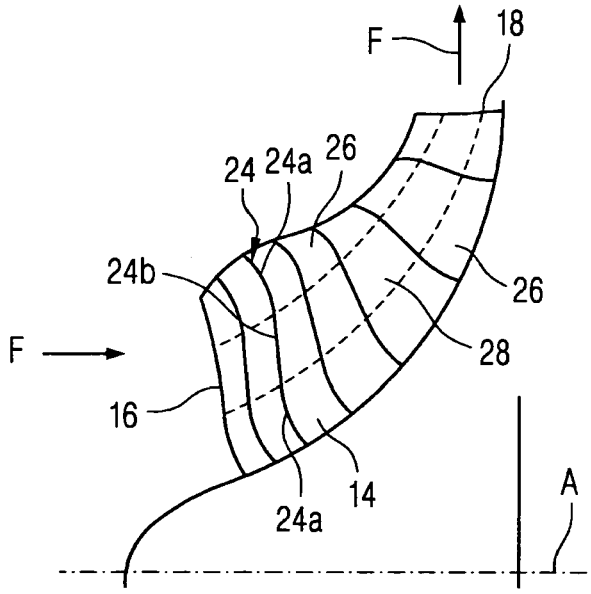
FIG. 6*a* shows a schematic side view of a blade having a leading edge repeatedly curved.
Figure 6B:
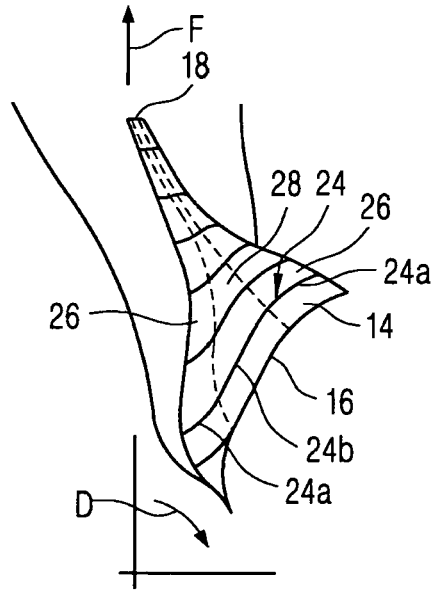
FIG. 6*b* shows a schematic plan view of the blade according to FIG. 6*a*.

The exemplary embodiment according to FIG. 6*a* and FIG. 6*b* is essentially a combination of the exemplary embodiments according to FIGS. 4*a*, 4*b* and FIGS. 5*a*, 5*b*. In the exemplary embodiment according to FIGS. 6*a*, 6*b*, the generatrix 24 is composed of two regions 24*a* which are curved in opposite directions and are connected to one another via a ruled-surface region 24*b*. Here, too, therefore, two marginal, double-curved sections 26 and a ruled-surface section 28 arranged in between are provided.

The double-curved section 26 shown in the figures covers in each case a large surface region of the blade surface of—depending on the exemplary embodiment—20% to 60% of the entire surface. Only in the exemplary embodiment according to FIGS. 3*a*, 3*b* does the curved section 26 form 100% or virtually 100% of the entire surface.

The sections 26, 28 are only indicated roughly in the figures by the broken line. Since the curvature trend changes in the longitudinal direction of the blade 14, there is the possibility that, within the sections 26 shown, within limited parts, the generatrix will not be curved but rather a line. This may occur, for example, if the curvature within a section 26 is changed from convex to concave.

Figure 7:
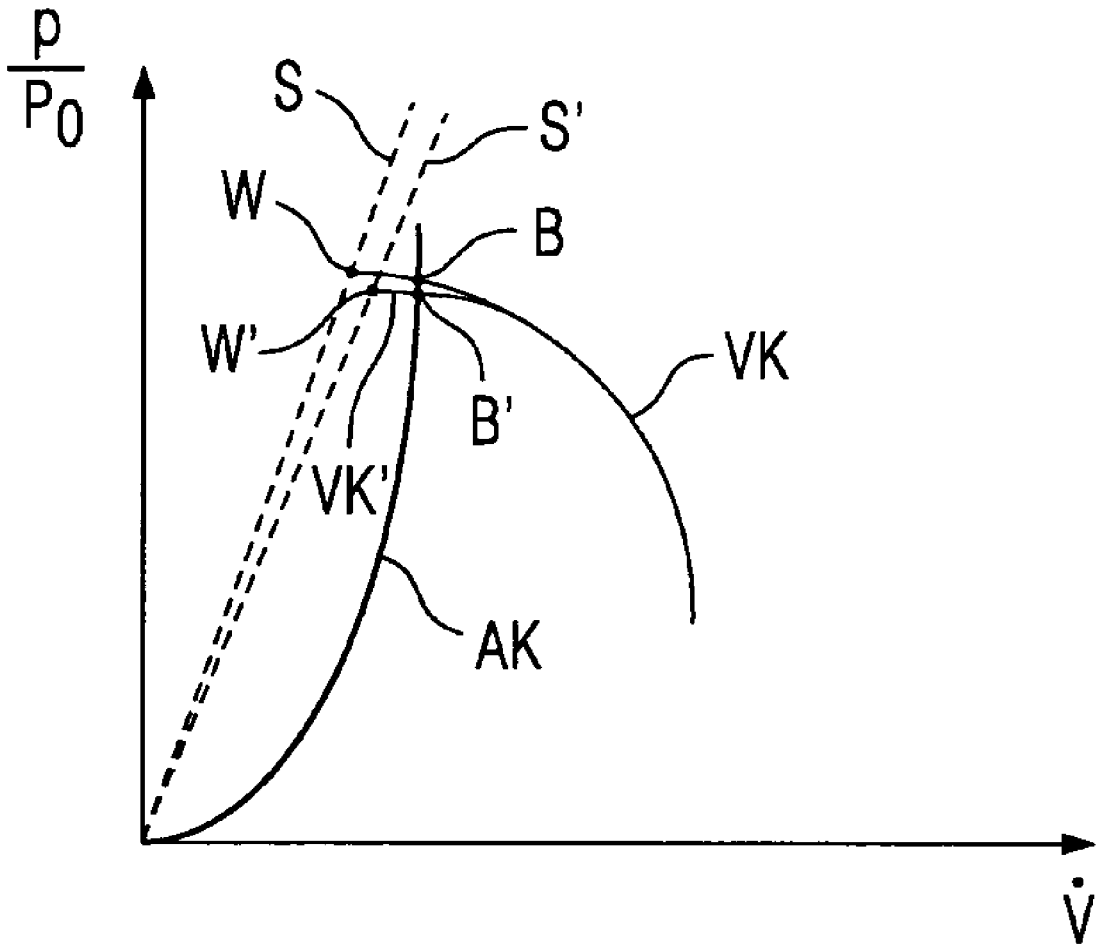
FIG. 7 shows the compressor characteristic of a radial compressor.

The operating behavior of the radial compressor 2 for a certain speed is described qualitatively with reference to the diagram in FIG. 7 by a compressor characteristic VK. In this diagram the pressure ratio $$\frac{p}{P_0}$$

is plotted against the volumetric flow $\dot{V}$, where p is the delivery pressure at the outlet of the compressor 2 and $P_0$ is the intake pressure at the leading edge 16. The characteristic VK is limited on the left-hand side by the surge limits. There, the flow separates from the blades 14 when volumetric flows are too low and pressure ratios are too high. The point on the characteristic VK at which this occurs is the separation point W. The operating point B of the radial compressor 2 is the intersection between the compressor characteristic VK and a system characteristic AK. As a rule, B shifts on the compressor characteristic VF as a function of the system parameters.

In order to illustrate the effect of the blades 14 according to the invention on the properties of the radial compressor 2, the compressor characteristic VK' and the associated separation point W' and surge limit S' of a conventional radial compressor are shown. Thanks to the increased aerodynamics of the blades 14, the rise in the characteristic VK is steeper in the direction of the surge limit. The result of this is that the operating point B lies at higher pressure ratios than the operating point B' of a conventional radial compressor if the two compressors deliver roughly the same quantity of delivery gas, such that a high efficiency of the radial compressor 2 is achieved. A further improvement in the compressor characteristic values is the displacement of the separation point W toward lower volumetric flows $\dot{V}$ than the separation point W' of a conventional radial compressor. The flow behavior of the delivery gas is therefore stabilized and the radial compressor 2 still works satisfactorily and reliably at low volumetric flows $\dot{V}$.

The invention claimed is:

1. A radial compressor rotor, comprising:

a wheel disk arranged on the rotor; and a plurality of blades arranged uniformly in a circumferential direction on the wheel disk where each blade has a leading edge, a trailing edge, a hub edge that adjoins the wheel disk, and an outer edge opposite to the hub edge, wherein a surface of the blade includes a double-curved section and a ruled-surface section, such that a generatix along a transverse direction between the hub edge and the outer edge is subdivided into a curved line and a straight line, the curved line and the straight line corresponding respectively to the double-curved section and the ruled-surface section, wherein the transition from the double-curved section to the ruled-surface section is continuous.

2. The radial compressor rotor as claimed in claim 1, wherein the double-curved section adjoins the outer edge and the ruled-surface section adjoins the hub edge.

3. The radial compressor rotor as claimed in claim 2, wherein the double-curved section and/or the ruled-surface section extends from the leading edge up to the trailing edge.

4. The radial compressor rotor as claimed claim 3, wherein the double-curved section and the ruled-surface section are approximately the same size.

5. The radial compressor rotor as claimed in claim 4, wherein the surface of the blades has a plurality of double-curved sections separated from one another by a ruled-surface section.

6. The radial compressor rotor as claimed in claim 5, wherein two double-curved sections are provided adjacent to the hub edge and the outer edge, where a ruled-surface section is arranged between the double-curved sections.

7. The radial compressor rotor as claimed in claim 6, wherein the entire surface of the blades is curved and has a curved line as generatix.

8. The radial compressor rotor as claimed in claim 7, wherein the leading edge is curved.

9. The radial compressor rotor as claimed in claim 8, wherein the curvature trend of the generatix varies from the leading edge in the direction toward the trailing edge.

10. The radial compressor rotor as claimed in claim 9, wherein the wheel disk, the blades and/or a cover disk forms separate units.

11. A method of producing a radial compressor rotor, comprising:

providing wheel disk on the rotor; and providing blades on the wheel disk arranged uniformly in the circumferential direction, wherein at least regions of a surface of the blades are produced by end mills in such a way that the surface of the blade includes a double-curved section and a ruled-surface section, such that a generatix along a transverse direction, between a hub edge of the blade adjoining the wheel disk and an outer edge opposite to the hub edge, is subdivided into a curved line and a straight line the curved line and the straight line corresponding respectively to the double-curved section and the ruled-surface section, wherein the transition from the double-curved section to the ruled-surface section is continuous.

12. The method as claimed in claim 11, wherein the double-curved section adjoins the outer edge and the ruled-surface section adjoins the hub edge.

13. The method as claimed in claim 12, wherein the double-curved section and/or the ruled-surface section extends from the leading edge up to the trailing edge.

14. The method as claimed claim 13, wherein the double-curved section and the ruled-surface section are approximately the same size.

15. The method as claimed in claim 14, wherein the surface of the blades has a plurality of double-curved sections separated from one another by a ruled-surface section.

16. The method as claimed in claim 15, wherein two double-curved sections are provided adjacent to the hub edge and the outer edge, where a ruled-surface section is arranged between the double-curved sections.

* * * * *